US012515853B2

(12) United States Patent
Filippini

(10) Patent No.: US 12,515,853 B2
(45) Date of Patent: Jan. 6, 2026

(54) LID-SPOUT ASSEMBLY FOR A PACKAGE AND PACKAGE HAVING A LID-SPOUT ASSEMBLY

(71) Applicant: Tetra Laval Holdings & Finance S.A., Pully (CH)

(72) Inventor: Maurizio Filippini, Modena (IT)

(73) Assignee: Tetra Laval Holdings & Finance S.A., Pully (CH)

( * ) Notice: Subject to any disclaimer, the term of this patent is extended or adjusted under 35 U.S.C. 154(b) by 144 days.

(21) Appl. No.: 17/923,583

(22) PCT Filed: May 21, 2021

(86) PCT No.: PCT/EP2021/063626
§ 371 (c)(1),
(2) Date: Nov. 6, 2022

(87) PCT Pub. No.: WO2021/239611
PCT Pub. Date: Dec. 2, 2021

(65) Prior Publication Data

US 2023/0182972 A1 Jun. 15, 2023

(30) Foreign Application Priority Data

May 27, 2020 (EP) ..... 20176812

(51) Int. Cl.
*B65D 47/14* (2006.01)
*B65D 5/74* (2006.01)
*B65D 43/02* (2006.01)

(52) U.S. Cl.
CPC ..... *B65D 47/141* (2013.01); *B65D 5/746* (2013.01); *B65D 43/0272* (2013.01)

(58) Field of Classification Search
CPC .. B65D 47/141; B65D 5/746; B65D 43/0272; B65D 2401/15
See application file for complete search history.

(56) References Cited

U.S. PATENT DOCUMENTS 3,269,575 A 8/1966 Hammes
3,595,441 A * 7/1971 Grosjean ..... B65D 35/44 222/541.2
6,540,114 B1 * 4/2003 Popovich ..... B65D 47/147 215/258

(Continued)

FOREIGN PATENT DOCUMENTS

DE 19947296 A1 4/2001
EP 3590856 A1 1/2020

(Continued)

OTHER PUBLICATIONS

International Search Report mailed Aug. 19, 2021, for priority International Patent Application No. PCT/EP2021/063626.

*Primary Examiner* — Donnell A Long
(74) *Attorney, Agent, or Firm* — Renner, Otto, Boisselle & Sklar, LLP

(57) ABSTRACT

A lid-spout assembly including at least a spout having a pouring outlet, a lid configured to selectively close and open the pouring outlet, a tethering element fixed to the lid and the spout and a tamper evidence element rupturably fixed to one of the lid and the spout and fixedly connected to the other one of the lid and the spout.

14 Claims, 4 Drawing Sheets

(56) References Cited

U.S. PATENT DOCUMENTS

| | | | | |
|---|---|---|---|---|
| 6,845,902 | B1 * | 1/2005 | Bomer | B65D 5/749<br>229/125.09 |
| 2007/0235406 | A1 * | 10/2007 | Young | B65D 47/0804<br>215/253 |
| 2008/0073348 | A1 * | 3/2008 | Pritikin | B65D 47/147<br>222/1 |
| 2015/0037113 | A1 * | 2/2015 | Maness | B60P 7/065<br>137/232 |

FOREIGN PATENT DOCUMENTS

| | | | |
|---|---|---|---|
| EP | 3590857 | A1 | 1/2020 |
| GB | 1459778 | A | 12/1976 |
| JP | 2001504782 | A | 4/2001 |

* cited by examiner

LID-SPOUT ASSEMBLY FOR A PACKAGE AND PACKAGE HAVING A LID-SPOUT ASSEMBLY

TECHNICAL FIELD

The present invention relates to a lid-spout assembly for a package, in particular a package having a sealed main body, filled with a pourable product, even more particular filled with a pourable food product.

Advantageously, the present invention also relates to a package, in particular a package having a sealed main body, filled with a pourable product, even more particular filled with a pourable food product, and comprising a lid-spout assembly.

BACKGROUND ART

As is known, many liquid or pourable food products, such as fruit juice, UHT (ultra-high-temperature treated) milk, wine, tomato sauce, etc., are sold in packages, in particular sealed packages, made of sterilized packaging material.

A typical example is the parallelepiped-shaped package for pourable food products known as Tetra Brik Aseptic (registered trademark), which is made by sealing and folding a laminated strip packaging material. The packaging material has a multilayer structure comprising a carton and/or paper base layer, covered on both sides with layers of heat-seal plastic material, e.g. polyethylene. In the case of aseptic packages for long-storage products, the packaging material also comprises a layer of oxygen-barrier material, e.g. an aluminum foil, which is superimposed on a layer of heat-seal plastic material, and is in turn covered with another layer of heat-seal plastic material forming the inner face of the package eventually contacting the food product.

Some of the known packages are designed for the consumption on-the-go. i.e. the package is provided with means which allow a consumer to consume the pourable product without the need to pour the pourable product into another container such as a drinking glass or a drinking cup prior to its consumption.

One of the known means may be a straw, which is to be introduced into a main body of the package, the main body containing the pourable product. Prior to its use, the straw is wrapped within an envelope, which typically is attached together with the straw to the main body. Thus, prior to a first-time use, the straw has to be extracted from the envelope. A drawback of such packages is seen in that the presence of a straw and its envelope may lead to an unwanted or undesired littering of the envelope and/or the straw.

Alternative solutions are described in the European patent applications EP-A-3590856 and EP-A-3590857 by the same Applicant. Both European patent applications describe respective packages resolving the inconveniences related to the packages being provided with straws and their envelopes. Each one of the packages disclosed in the above-mentioned European patent applications comprises a sealed main body having a designated pour opening and a lid-spout assembly arranged on the main body about the designated pour opening and configured to allow for a controlled outpouring of the pourable product so that the consumer can consume the pourable product directly from the package.

Each lid-spout assembly comprises a spout having a pouring outlet and a lid removably coupled to the spout so as to selectively close and open the pouring outlet. In particular, the lid is movable between at least a closed position in which the lid covers the pouring outlet and an open position in which the lid opens the pouring outlet.

Prior to the first-time control of the lid from the closed configuration to the open configuration, the lid is rupturably fixed to the collar for sealing a flow channel of the collar and thereby an inner space of the main body.

The spout comprises a base frame for coupling the spout to the main body about the designated pour opening and a collar carrying the pouring outlet and protruding from the base frame.

In order to avoid any unwanted littering of the lid, the lid-spout assembly also comprises a tethering element connecting the lid and the spout with one another. In particular, the tethering element is fixed to the lid and the base frame.

Even though such lid-spout assemblies work satisfyingly well, a desire is felt in the sector to further improve such lid-spout assemblies, in particular so as to guarantee that a consumer is able to understand whether the lid has already been controlled at least once from the closed position to the open position.

Disclosure of Invention

It is therefore an object of the present invention to provide in a straightforward and low-cost manner an improved lid-spout assembly for a package, in particular a package having a sealed main body, filled with a pourable product, even more particular filled with a pourable food product.

In particular, it is an object of the present invention to provide in a straightforward and low-cost manner an improved lid-spout assembly for a package, in particular a package having a sealed main body, filled with a pourable product, even more particular filled with a pourable food product, which ensures a user to understand whether the lid has already been controlled at least once from the closed position to the open position.

It is a further object of the present invention to provide in a straightforward and low-cost manner a package, in particular a package having a sealed main body, filled with a pourable product, in particular filled with a pourable food product, having a lid-spout assembly, in particular the lid-spout assembly being designed to ensure a user to understand whether the lid has already been controlled at least once from the closed position to the open position.

According to the present invention, there is provided a lid-spout assembly according to the independent claim.

Further advantageous embodiments of the lid-spout assembly are specified in the respective dependent claims.

According to the present invention, there is also provided a package that includes a main body and a lid spout assembly according to any of the embodiments.

BRIEF DESCRIPTION OF THE DRAWINGS

A non-limiting embodiment of the present invention will be described by way of example with reference to the accompanying drawings, in which.

BEST MODES FOR CARRYING OUT THE INVENTION

Number 1 indicates as a whole a package comprising:

- a (sealed) main body 2, in particular a sealed carton body, being filled with a pourable product, in particular a pourable food product, and having a designated pour opening (not shown and known as such) configured to allow for an outflow of the pourable product from main body 2; and
- a lid-spout assembly 3 coupled to main body 2 arranged and/or arrangeable about the designated pour opening and configured to allow for a controlled outpouring of the pourable product from main body 2, in particular so that a consumer can consume the pourable product directly through lid-spout assembly 3 and/or from package 1.

Preferentially, package 1 is designed for the consumption on-the-go, i.e. the consumer can consume the pourable product directly from package 1 without the need of any intermediate means such as drinking glasses, drinking cups or similar.

Preferentially, lid-spout assembly 3 is designed for the consumption on-the-go, i.e. the consumer can consume the pourable product directly through lid-spout assembly 3.

According to some preferred non-limiting embodiments, main body 2 is obtained from a packaging material, in particular a composite packaging material, having a multi-layer structure (not shown and known as such).

Preferentially, the packaging material is provided in the form of a web.

Preferentially, main body 2 is obtained by forming a tube from the packaging material, longitudinally sealing the tube, filling the tube with the pourable product and by transversally sealing and cutting the tube.

Preferentially, the packaging material comprises at least one layer of fibrous material, such as e.g. paper or cardboard, and at least two layers of heat-seal plastic material, e.g. polyethylene, interposing the layer of fibrous material in between one another. One of these two layers of heat-seal plastic material defining the inner face of main body 2 contacting the pourable product.

Preferably, the packaging material also comprises a layer of gas- and light-barrier material, e.g. aluminum foil or ethylene vinyl alcohol (EVOH) film, in particular being arranged between one of the layers of the heat-seal plastic material and the layer of fibrous material. Preferentially, the packaging material also comprises a further layer of heat-seal plastic material being interposed between the layer of gas- and light-barrier material and the layer of fibrous material.

According to some non-limiting embodiments, lid-spout assembly(ies) 3 is/are applied to the packaging material prior to arranging the packaging material within or during advancement of the packaging material through a packaging machine for forming, filling and sealing main bodies 2 from the packaging material carrying lid-spout assembly(ies) 3.

In particular, application of lid-spout assembly(ies) 3 to the packaging material occurs by means of a molding process and/or adhesive bonding and/or ultrasonic bonding.

Figure 1B:
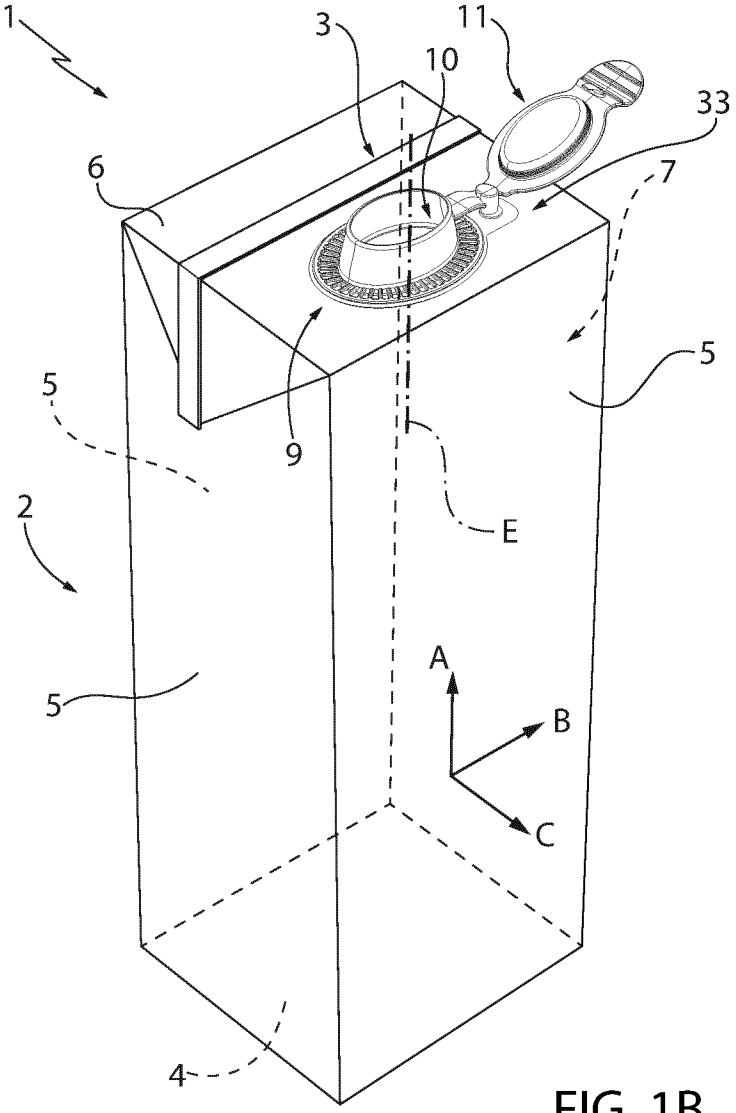
FIG. 1B is a schematic perspective view of the package of FIG. 1A with the lid-spout assembly being in a second configuration, with parts removed for clarity.
Figure 1A:
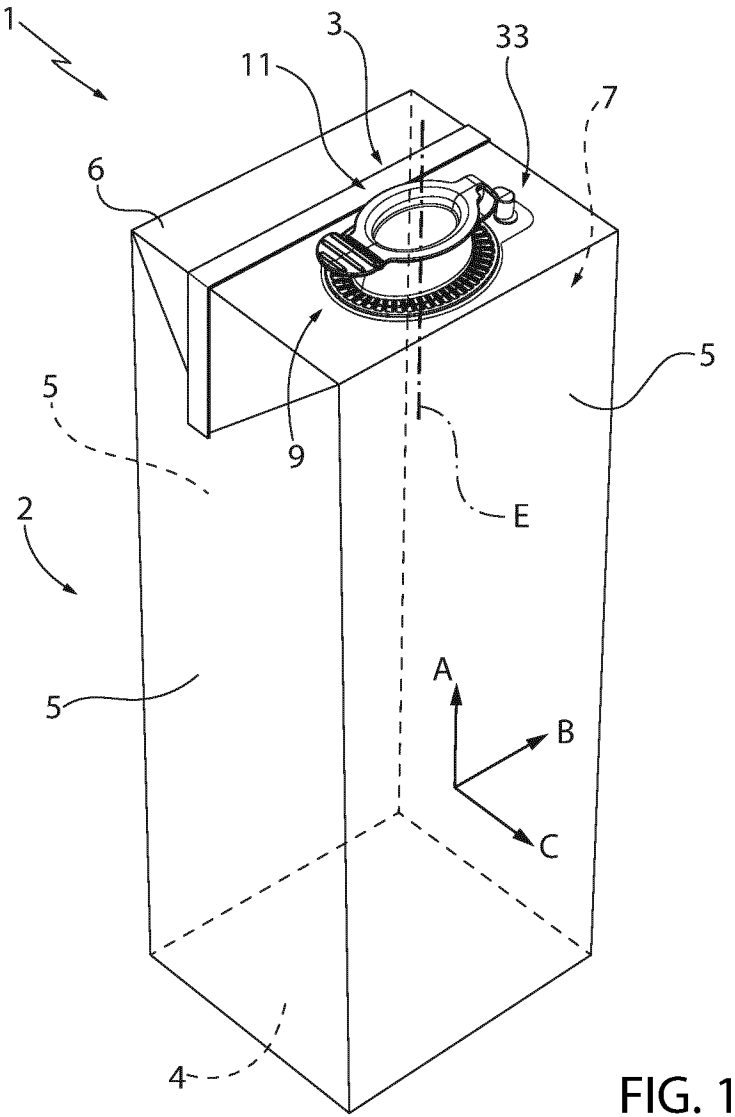
FIG. 1A is a schematic perspective view of a package having a lid-spout assembly according to the present invention and being in a first configuration, with parts removed for clarity.
Figure 2:
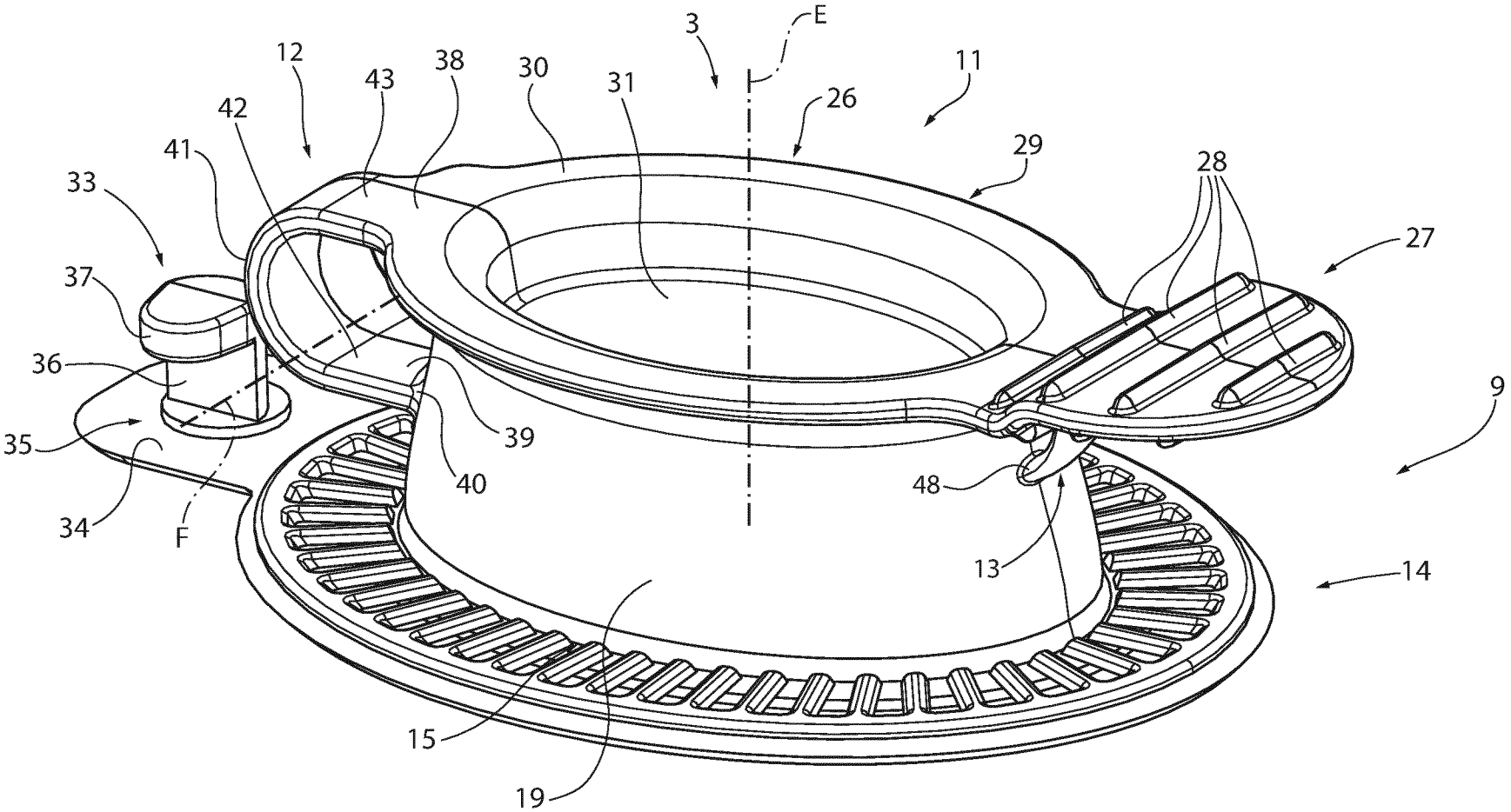
FIG. 2 is an enlarged perspective view of the lid-spout assembly of FIG. 1A being in the first configuration, with parts removed for clarity.

With particular reference to FIGS. 1A and 1B, main body 2 extends along a longitudinal axis A, a first transversal axis B and a second transversal axis C. In particular, the extension of package 2 along longitudinal axis A is larger than the extension of package 2 along first transversal axis B and second transversal axis C.

Preferentially, main body 2 is parallelepiped-shaped.

According to some preferred non-limiting embodiments, main body 2 comprises a first wall portion 4, in particular being transversal, even more particular perpendicular, to longitudinal axis A, from which main body 2 extends along longitudinal axis A. Preferably, first wall portion 4 defines a support surface of package 1, in particular of main body 2, which is designed to be put in contact with a support, such as e.g. a shelf, when, in use, being e.g. exposed within a sales point or when being stored. In particular, when being arranged on a support first wall portion 4 defines a bottom wall portion.

Preferably, main body 2 also comprises a plurality of lateral walls 5 being (fixedly) connected to first wall portion 4 and extending, in particular substantially parallel to longitudinal axis A, from first wall portion 4.

Preferably, main body 2 also comprises a second wall portion 6 opposite to first wall portion 4 and being (fixedly) connected to at least some of lateral walls 5. In particular, lateral walls 5 are interposed between first wall portion 4 and second wall portion 6. In particular, when main body 2 is arranged on a support, second wall portion 6 defines a top wall portion.

According to some non-limiting embodiments, first wall portion 4 and second wall portion 6 may be parallel to one another.

According to a non-limiting alternative embodiment not shown, first wall portion 4 and second wall portion 6 could be inclined with respect to one another.

According to some non-limiting embodiments, second wall portion 6 carries and/or comprises the designated pour opening.

According to some preferred non-limiting embodiments, package 1, in particular main body 2, comprises an inner space 7 configured to contain and/or containing the pourable product. In particular, at least first wall portion 4, lateral walls 5 and second wall portion 6 delimit inner space 7.

With particular reference to FIGS. 1A to 5, lid-spout assembly 3 comprises at least:

- a spout 9 being connected or being connectable to main body 2 about the designated pour opening and having a pouring outlet 10 configured to allow for a (controlled) outflow of the pourable product from spout 9 itself (and therewith main body 2 and/or package 1);
- a lid 11 coupled to spout 9 and configured to selectively close and open pouring outlet 10;
- a tethering element 12 (permanently) tethering and/or coupling lid 11 to spout 9; and
- a tamper evidence element 13 rupturably fixed to one of lid 11 and spout 9, in the specific case disclosed to spout 9, and (non-rupturably/permanently) fixed to the other one of lid 11 and spout 9, in the specific case disclosed to lid 11.

In particular, in the context of the present application, "rupturably fixed" means that the connection is such that the respective connection of the tamper evidence element 13 with lid 11 or spout 9, in the specific embodiment disclosed with spout 9, can be interrupted (broken). In other words, "rupturably fixing" indicates the possibility to disengage and/or separate tamper evidence element 13 from lid 11 or spout 9. In particular, the connection may be disengaged and/or interrupted by means of the application of a force, which is in accordance with a normal and/or desired use of lid-spout assembly 3.

In particular, furthermore, within the scope of the present application, the term "fixed" indicates that the respective connection between the other one of lid 11 and spout 9, in the specific case disclosed with lid 11, is permanent. In particular, during a normal use of lid-spout assembly 3 tamper evidence element 13 cannot be separated from the other one of lid 11 and spout 9, in the specific embodiment disclosed from lid 11.

According to some preferred non-limiting embodiments, lid 11 is controllable between at least:

- a closed position (see FIGS. 1A, 2 and 3) in which lid 11 is configured to cover and/or covers pouring outlet 10, in particular for impeding an outflow of the pourable product out of pouring outlet 10; and
- an open position (see FIGS. 1B, 4 and 5) in which lid 11 is configured to be and/or is detached from pouring outlet 10, in particular for allowing an outflow of the pourable product through pouring outlet 10.

In particular, lid 11 is configured to close and open the pouring outlet 10 when being respectively in the closed position and the open position.

Preferentially, lid 11 is in a first angular position and in a second angular position with respect to a hinge axis F when being controlled in respectively the closed position and the open position.

It should be noted that package 1 is immediately after its formation in an initial configuration in which lid 11 is in the closed position. Package 1 is distributed and/or sold to a consumer while being in the initial configuration (and lid 11 has not yet been controlled from the closed position to the open position).

Advantageously, tamper evidence element 13 is rupturably fixed to one of lid 11 and spout 9, in the specific case disclosed to spout 9, and (non-rupturably) fixed to the other one of lid 11 and spout 9, in the specific case disclosed to lid 11, prior to the first time lid 11 is controlled from the closed position to the open position. In particular, tamper evidence element 13 is designed such that in use and during the first-time control of lid 11 from the closed position to the open position, tamper evidence element 13 separates from lid 11 or spout 9, in the specific case disclosed from spout 9, even more particular due to the respective connection being designed to rupture. In particular, rupturably fixed also means that the rupture is also irreversible. Thus, once the respective connection has been ruptured, the connection cannot be established again.

In more detail and with particular reference to FIGS. 1A to 5, spout 9 comprises at least:

- a base frame 14 coupling and/or configured to couple spout 9 to main body 2, in particular to second wall portion 6, about the designated pour opening; and
- a collar 15 carrying (comprising) pouring outlet 10 and being fixed to base frame 14 and protruding from base frame 14.

According to some preferred non-limiting embodiments, lid-spout assembly 3, in particular spout 9, lid 11, tethering element 12 and tamper evidence element 13, is/are formed in a single piece.

According to some preferred non-limiting embodiments, lid-spout assembly 3, in particular spout 9, lid 11, tethering element 12 and tamper evidence element 13, is/are formed and/or molded, in particular simultaneously molded, from a polymer and preferentially in a single piece. In particular, lid-spout assembly 3 is directly molded on the packaging material about the designated pour opening.

Preferentially, collar 15 extends along a longitudinal axis E, in particular transversal, even more particular, perpendicular to wall portion 6, and carries (comprises) pouring outlet 10 at a first axial end of collar 15 itself, and in particular an inlet opening 16 for the pourable product at a second axial end of collar 15 itself opposite to the first axial end.

Preferentially, collar 15 delimits (and/or comprises) a flow channel 17 for the pourable product, in particular extending between inlet opening 16 and pouring outlet 10. In use, collar 15 is configured such to receive the pourable product from inner space 7 through inlet opening 16 and such that the pourable product flows out of pouring outlet 10, in particular with lid 11 being in the open position (otherwise with lid 11 being in the closed position, lid 11 blocks the outflow of the pourable product).

Preferentially, collar 15 comprises an inner surface 18 delimiting flow channel 17 and an outer surface 19 opposite to inner surface 18.

Preferentially, collar 15 has a tubular configuration.

Preferentially, collar 15 has an annular cross-sectional profile with respect to a cross-sectional plane perpendicular to longitudinal axis E. In particular, the annular cross-sectional profile has an oval shape. Alternatively, the annular cross-sectional profile could have a circular or square or elliptical or rectangular shape.

Preferentially, collar 15 comprises a first rim 20 delimiting pouring outlet 10, and in particular a second rim opposite to first rim 20 and delimiting inlet opening 16. In particular, first rim 20 is arranged at the first axial end of collar 15 and the second rim is arranged at the second axial end of collar 15.

In particular, first rim 20, even more particular also the second rim, has/have a respective oval shape. Alternatively, first rim 20 and/or the second rim could have a square and/or a rectangular and/or an elliptical and/or circular shape.

According to some preferred non-limiting embodiments, collar 15, in particular first rim 20, is designed such to allow a consumer to drink from spout 9, in particular collar 15.

Preferentially, collar 15 is shaped such to facilitate the outflow of the pourable product from collar 15 itself.

Figure 3:
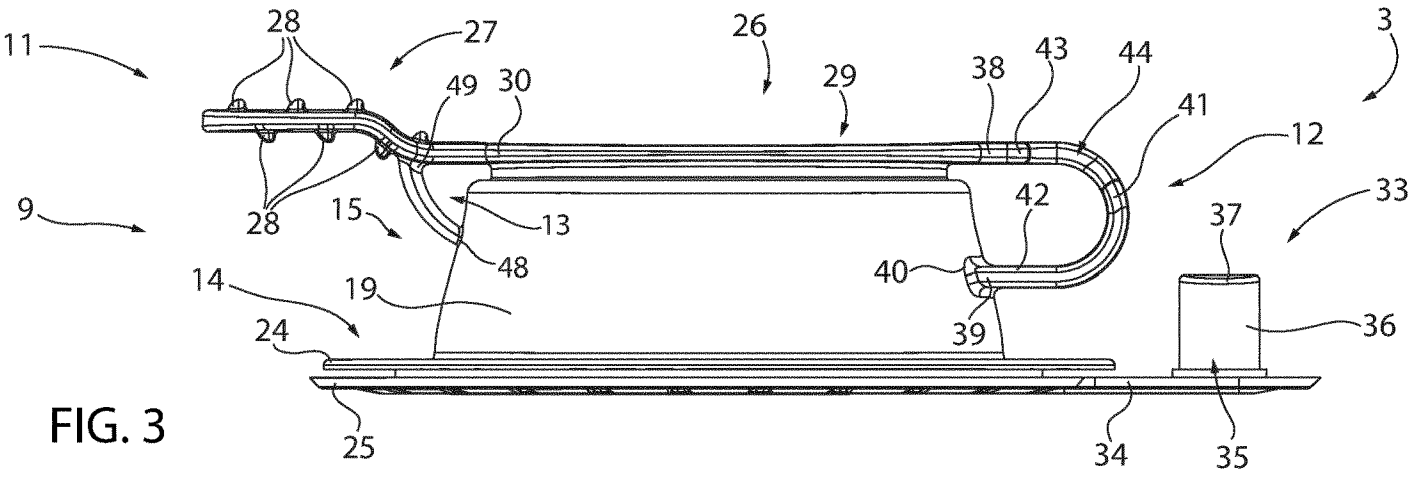
FIG. 3 is an enlarged side-view of the lid-spout assembly being in the first configuration, with parts removed for clarity.
Figure 4:
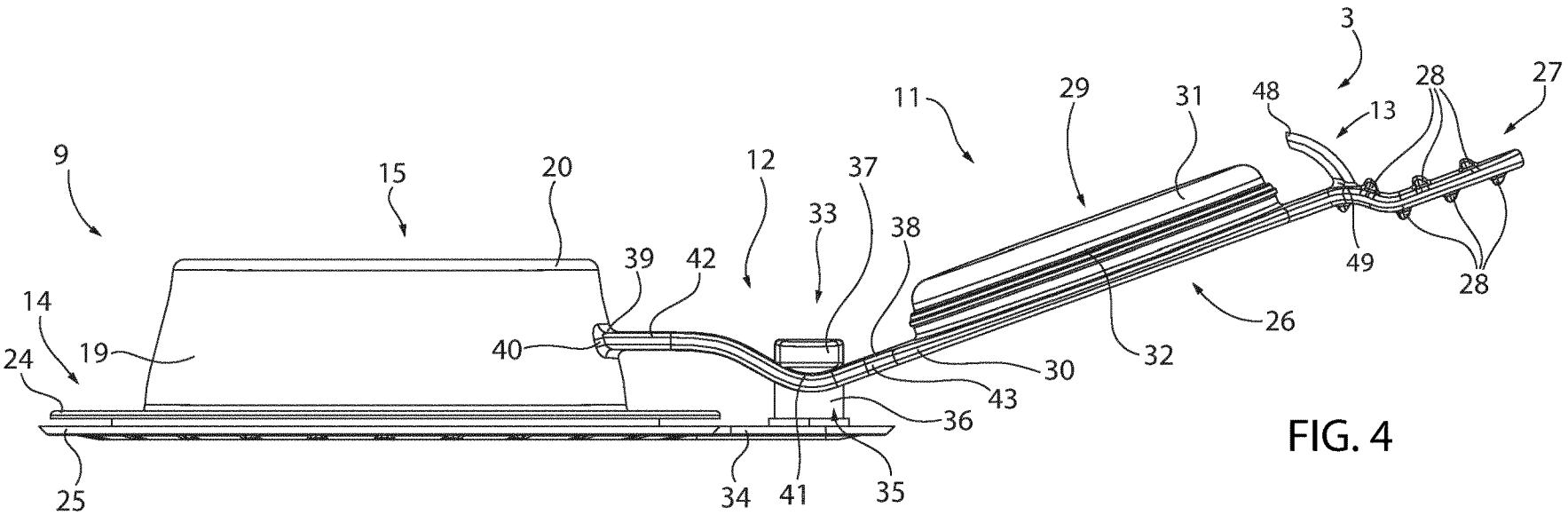
FIG. 4 is an enlarged side-view of the lid-spout assembly being in the second configuration, with parts removed for clarity.
Figure 5:
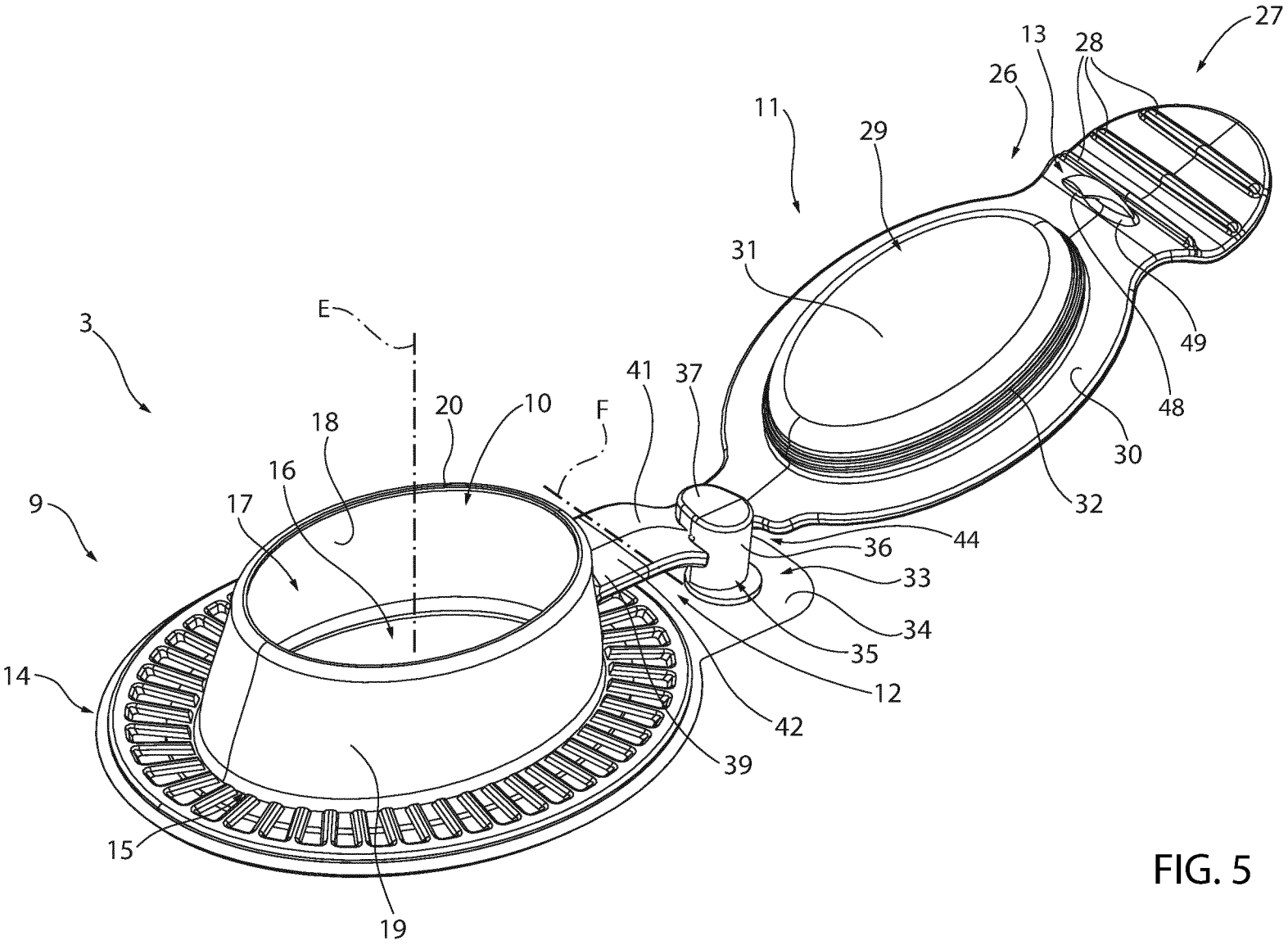
FIG. 5 is an enlarged perspective view of the lid-spout assembly being in the second configuration, with parts removed for clarity.

With particular reference to FIGS. 3 and 4, base frame 14 comprises a first annular portion 24 and a second annular portion 25 axially displaced from one another with respect to longitudinal axis E and configured to interpose and/or interposing a portion of main body 2, in particular second wall portion 6, between one another. In particular, the portion of main body 2, in particular second wall portion 6, is at the designated pour opening.

Preferentially, first annular portion 24 comprises a first engagement surface configured to contact an outer surface of main body 2 and second annular portion 25 comprises a second engagement surface configured to contact an inner surface of main body 2, the inner surface facing inner space 7. In particular, the first engagement surface and the second engagement surface face one another.

According to some preferred non-limiting embodiments, lid 11 comprises at least a main portion 26 configured to at least partially protrude and/or at least partially protruding into flow channel 17, and in particular to seal pouring outlet 10, in particular when being arranged in the closed position.

Preferentially, main portion 26 is shaped like a hat or is hat-like shaped.

Preferentially, lid 11 also comprises a gripping element 27 protruding, in particular laterally protruding, from main portion 26, and in particular being configured to allow the consumer to grip gripping element 27 itself so that the consumer can control lid 11 between the closed position and the open position. In particular, gripping element 27 comprises ribs 28 improving the gripping properties of gripping element 27.

According to some preferred non-limiting embodiments, main portion 26 comprises at least:

- a central section 29 at least partially protruding and/or configured to at least partially protrude into flow channel 17, in particular with lid 11 being in the closed position; and
- a peripheral section 30 connected to and surrounding central section 29 and configured to engage and/or engaging collar 15, in particular first rim 20.

In particular, gripping element 27 laterally protrudes from peripheral section 30.

Preferentially, central section 29 comprises at least:

- a central wall 31, in particular transversal, even more particular perpendicular, to longitudinal axis E with lid 11 being in the closed position; and
- a lateral wall 32 fixed to and protruding from central wall 31, and in particular configured to engage inner surface 18 with lid 11 being in the closed position.

In particular, lateral wall 32 is fixed to central wall 31 at a first end of lateral wall 32 itself and to peripheral section 30 at a second end of lateral wall 32 itself.

According to some preferred non-limiting embodiments, central wall 31 is arranged within flow channel 17, in particular between pouring outlet 10 and inlet opening 16, with lid 11 being arranged in the closed configuration.

According to some preferred non-limiting embodiments, lid 11 is rupturably fixed to collar 15, in particular first rim 20, in particular prior to the first time lid 11 is controlled from the closed position to the open position. In particular, lid 11, preferentially main portion 26, even more particular central section 29 and/or peripheral section 30, is rupturably fixed in an irreversible manner to collar 15, in particular first rim 20. Thus, after the first-time control of lid 11 from the closed position to the open position, it is again possible to control lid 11 in the closed position and to establish contact between lid 11 and collar 15, but lid 11 is not fixed to collar 15 anymore.

Preferentially, lid-spout assembly 3 also comprises a coupling membrane, in particular an annular coupling membrane, rupturably fixing lid 11 and collar 15 to one another, in particular prior to the first time lid 11 is controlled from the closed position to the open position.

According to some non-limiting embodiments, the coupling membrane is interposed between and is fixed to inner surface 18 and lateral wall 32.

According to some non-limiting embodiments, lid 11, in particular main portion 26, even more particular central section 29, comprises the coupling membrane.

According to alternative non-limiting embodiments, collar 15 comprises the coupling membrane.

According to alternative non-limiting embodiments, lid 11 and collar 15 each comprises a respective portion of the coupling membrane.

In particular, lid 11 is rupturably fixed to collar 15, in particular by means of the coupling membrane, so as to seal flow channel 17 (and as a consequence inner space 7) from an outer environment.

According to some preferred non-limiting embodiments, lid 11 is bonded and/or welded and/or molded to collar 15, in particular by means of the coupling membrane, so as to rupturably fix lid 11 to collar 15.

According to some preferred non-limiting embodiments, lid spout-assembly 3 further comprises a retaining group 33 configured to interact with tethering element 12 and/or lid 11 for (at least) temporarily retaining lid 11 in the open position. In particular, "temporarily retaining" means that the interaction is such that tethering element 12 and/or lid 11 can be disengaged from retaining group 33 again.

In particular, tethering element 12 is designed to be (temporarily) coupled to retaining group 33 for retaining lid 11 in the open position.

Preferentially, lid spout-assembly 3 further comprises a connection base 34 fixed to and protruding, in particular laterally protruding away, from base frame 14 and carrying retaining group 33. In particular, connection base 34 is substantially parallel to base frame 14.

In particular, connection base 34 is connected to second annular portion 25, even more particular laterally protrudes from second annular portion 25.

Preferentially, retaining group 33 comprises a hook element 35 configured to interact with tethering element 12 for retaining lid 11 in the open position.

Preferentially, hook element 35 transversally, in particular perpendicularly, extends from connection base 34.

In particular, hook element 35 comprises a support bar 36 being fixed to and transversally, in particular perpendicularly, protruding from connection base 34 and a hook 37 transversally protruding from support bar 36.

Advantageously, tethering element 12 comprises a first end 38 fixed to lid 11 and a second end 39, in particular opposite to first end 38, fixed to collar 15.

Preferentially, tethering element 12 is fixed to outer surface 19.

Even more preferentially, tethering element 12 is fixed to a central portion 40 of collar 15.

According to some preferred non-limiting embodiments, first end 38 is connected to main portion 26, in particular peripheral section 30. In particular, first end 38 is connected to a first zone of main portion 26, in particular peripheral section 30, and gripping element 27 is connected to a second zone of main portion 26, in particular peripheral section 30. Preferentially, the first zone is opposite to the second zone.

According to some preferred non-limiting embodiments, tethering element 12 presents a (substantially) two-dimensional shape, in particular such that when being non-stressed tethering element 12 extends along a respective longitudinal axis and a second axis transversal to the longitudinal axis. In particular, an extension of tethering element 12 along the longitudinal axis is larger than an extension of tethering element 12 along the second axis. Even more particular, an extension along a third axis transversal to the longitudinal axis and the second axis is negligible and/or smaller with respect to the corresponding extensions along the longitudinal axis and the second axis.

According to some preferred non-limiting embodiments, tethering element 12 is bendable and/or flexible and/or deflectable.

Preferentially, tethering element 12 is configured to modify its shape in dependence of the position of lid 11. Preferentially, tethering element 12 is controllable between at least a first configuration with lid 11 being in the closed position and a second configuration (distinct from the first configuration) with lid 11 being in the open configuration.

According to some preferred non-limiting embodiments, tethering element 12 comprises a bendable portion 41 configured to modify its shape in dependence of the position of lid 11. In particular, bendable portion 41 is configured to modify its shape during control of lid 11 between the closed position and the open position (and accordingly of tethering element 12 between the first configuration and the second configuration).

Preferentially, tethering element 12 also comprises a first straight portion 42 having second end 39, and in particular being fixed in shape. In particular, first straight portion 42 is connected to bendable portion 41 and transversally protrudes from outer surface 19. Even more preferentially, straight portion 42 is perpendicular to longitudinal axis E.

Even more preferentially, first straight portion 42 defines hinge axis F.

Preferably, first straight portion 42 transversally (and laterally), in particular perpendicularly (and laterally) protrudes, from collar 15.

Preferably, first straight portion 42 extends (substantially) parallel to base frame 14 and/or second wall portion 6, in particular irrespective of whether lid 11 is in the closed position or the open position.

Preferentially, tethering element 12 also comprises a second straight portion 43 having first end 38, and in particular being fixed in shape. In particular, second straight portion 43 is connected to bendable portion 41 and transversally, in particular perpendicularly, protrudes from lid 11, in particular main portion 26, even more particular peripheral section 30.

Preferentially, second straight portion 43 is (substantially) parallel to base frame 14 and/or second wall portion 6 with lid 11 being in the open configuration (and in particular with lid 11 and/or tethering element 12 interacting with retaining group 33).

In the present context, substantially parallel means that second straight portion 43 may deviate from a perfect parallel alignment. However, the angle between second straight portion 43 and base frame 14 and/or second wall portion 6 (considering appropriate imaginary extensions) is negligible.

Preferentially, bendable portion 41 is interposed between first straight portion 42 and second straight portion 43.

According to some preferred non-limiting embodiments, tethering element 12, in particular bendable portion 41, presents a curved shape, in particular a curved U-shape, when being in the first configuration and/or with lid 11 being in the closed configuration.

Preferentially, tethering element 12, in particular bendable portion 41 presents a S-shape with lid 11 being in the open configuration (and in particular with lid 11 and/or tethering element 12 interacting with retaining group 33).

According to some preferred non-limiting embodiments, tethering element 12 comprises a recess 44 configured to engage retaining group 33, in particular hook element 35, so as to (at least) temporarily fix lid 11 in the open position.

In particular, recess 44 is designed such that tethering element 12 engages a portion of support bar 36 and a portion of hook 37 for retaining lid 11 in the open configuration.

Preferentially, recess 44 is delimited by a main surface and two auxiliary surfaces spaced apart from one another and being transversal, in particular perpendicular, to main surface. In particular, auxiliary surfaces are designed such to interpose a portion of support bar 36 between one another with tethering element 12 being coupled to retaining group 33.

Preferentially, hook element 35, in particular hook 37, comprises an abutment surface, in particular facing main body 2, in particular second wall portion 6, and tethering element 12 is configured to abut against the abutment surface when being coupled to retaining group 33.

Advantageously and with particular reference to FIGS. 1A to 5, the connection between spout 9 and tamper evidence element 13 is established through contact of tamper evidence element 13 with collar 15 and/or base frame 14. In other words, tamper evidence element 13 is (non-rupturably/permanently) fixed or rupturably fixed, in the specific case disclosed rupturably fixed, to collar 15 and/or base frame 14.

Preferentially, tamper evidence element 13 is connected, in particular rupturably fixed, to collar 15, in particular outer surface 19. It should be considered that according to the embodiment shown, tamper evidence element 13 is rupturably fixed to collar 15 so that tamper evidence element 13 is separated from collar 15 the first time lid 11 is moved from the closed position to the open position.

According to some preferred non-limiting embodiments, tamper evidence element 13 is connected, in particular (non-rupturably/permanently) fixed, to gripping element 27, in particular to a first surface of gripping element 27 facing base frame 14 with lid 11 being in the closed position.

According to some preferred non-limiting embodiments, tamper evidence element 13 comprises a first end 48 and a second end 49 opposite to first end 48. In particular, first end 48 is rupturably fixed to one of lid 11 and spout 9 and second end 49 is fixedly connected to the other one of lid 11 and spout 9.

According to the embodiment shown, first end 48 is rupturably fixed to spout 9, in particular collar 15, even more particular outer surface 19, and second end 49 is fixed to lid 11, in particular gripping element 27, even more particular to the first surface of gripping element 27.

Preferentially, tamper evidence element 13 extends between first end 48 and second end 49 along a central extension axis. In particular, central extension axis is defined by a plurality of mid-points of tamper evidence element 13.

According to some preferred non-limiting embodiments, tamper evidence element 13 is curved (and as is the central extension axis). In particular, tamper evidence element 13 (and the central extension axis) has(have) a convex shape with respect to outer surface 19, in particular with lid 11 being in the closed position.

Alternatively, tamper evidence element 13 can have any other shape, such as having a concave shape with respect to outer surface 19, in particular with lid 11 being in the closed position, or having a straight shape or having an even more complex shape.

Preferentially, tamper evidence element 13 has an oval cross-sectional profile, in particular with respect to a cross-sectional plane transversal, in particular perpendicular, to the central extension axis. Alternatively, tamper evidence element 13 could have a circular cross-sectional profile.

According to some preferred non-limiting embodiments, tamper evidence element 13, in particular first end 48, comprises a first contact surface rupturably fixed to one of lid 11 and spout 9, in the specific example shown to spout 9, in particular collar 15, even more particular outer surface 19. Furthermore, tamper evidence element 13, in particular second end 49, comprises a second contact surface fixed to the other one of lid 11 and spout 9, in the specific case shown to lid 11, in particular gripping element 27, even more particular the first surface of gripping element 27.

Preferentially, the first contact surface is smaller than the second contact surface.

Preferentially, tamper evidence element 13 has a first cross-sectional profile, in particular with respect to a cross-sectional plane transversal, in particular perpendicular, to the central extension axis, at first end 48 and a second cross-sectional profile, in particular with respect to a cross-sectional plane transversal, in particular perpendicular, to the central extension axis, at second end 49. The first cross-sectional profile is smaller than the second cross-sectional profile.

In use, the outpouring of the pourable product from package 1 requires controlling lid 11 from the closed position to the open position so as to open pouring outlet 10.

The first time lid 11 is controlled from the closed position to the open position, lid 11 is separated from collar 15 so that the next time lid 11 is again arranged in the closed position, lid 11 is only connected to collar 15, but not fixed thereto.

Additionally, the first time lid 11 is controlled from the closed position to the open position, tamper evidence element 13 is, with particular reference to the embodiment disclosed, separated from spout 9. In an alternative embodiment not shown in which tamper evidence element 13 could be rupturably fixed to lid 11, tamper evidence 13 is separated from lid 11 during the first-time control of lid 11 from the closed position to the open position.

The advantages of lid-spout assembly 3 and/or of package 1 according to the present invention will be clear from the foregoing description.

In particular, by providing for tamper evidence element 13 a consumer obtains a clear visible indication on whether lid 11 has or has not yet been controlled at least once from the closed position to the open position.

A further advantage resides in the fact that tamper evidence element 13 has an efficient and robust design, in particular clearly defining the breaking point.

Clearly, changes may be made to lid-spout assembly 3 and/or package 1 as described herein without, however, departing from the scope of protection as defined in the accompanying claims.

The invention claimed is:

1. A lid-spout assembly for a package having a main body comprising a designated pour opening and being filled with a pourable product;

the lid-spout assembly comprises at least:

a spout having a pouring outlet;

a lid configured to selectively close and open the pouring outlet; and a tethering element fixed to the lid and the spout;

wherein the spout comprises at least:

a base frame configured to couple the spout to the main body about the designated pour opening;

a collar carrying the pouring outlet and protruding from the base frame;

wherein the lid is controllable between at least:

a closed position in which the lid covers the pouring outlet; and an open position in which the lid is detached from the pouring outlet;

wherein the lid-spout assembly also comprises an annular coupling membrane rupturably fixing the lid and the collar to one another prior to the first time the lid is controlled from the closed position to the open position;

wherein the lid-spout assembly further comprises a tamper evidence element;

wherein the tamper evidence element extends between a first end rupturably fixed directly to one of the lid and the collar and a second end directly fixed to the other one of the lid and the collar along a central extension axis, and wherein a curvature of the tamper evidence element extends from the first end to the second end; and the spout, the lid, the tethering element and the tamper evidence element are formed in a single piece so that the lid-spout assembly is in an initial configuration in which the lid is in the closed position.

2. The lid-spout assembly according to claim 1, wherein the collar comprises an inner surface delimiting a flow channel for the pourable product and an outer surface opposite to the inner surface;

wherein the tamper evidence element is rupturably fixed to the outer surface.

3. The lid-spout assembly according to claim 1, wherein the lid comprises a gripping element;

wherein the tamper evidence element is rupturably fixed or fixed to the gripping element.

4. The lid-spout assembly according to claim 3, wherein the lid comprises at least a main portion configured to at least partially protrude into the flow channel;

wherein the gripping element protrudes from the main portion.

5. The lid-spout assembly according to claim 4, wherein the main portion comprises at least a central section at least partially protruding into the flow channel and a peripheral section connected to and surrounding the central section and configured to engage and/or engaging a rim of the collar delimiting the pouring outlet.

6. The lid-spout assembly according to claim 1, wherein the tamper evidence element comprises a first end and a second end;

wherein the first end is rupturably fixed to one of the lid and the spout and the second end is fixedly connected to the other one of the lid and the spout.

7. The lid-spout assembly according to claim 6, wherein the tamper evidence element is designed such that, in use, the first time the lid is controlled from the closed position to the open position the first end irreversibly ruptures.

8. The lid-spout assembly according to claim 6, wherein the tamper evidence element has a first cross-sectional profile at the first end and a second cross-sectional profile at the second end;

wherein the first cross-sectional profile is smaller than the second cross-sectional profile.

9. The lid-spout assembly according to claim 1, wherein the tamper evidence element comprises a first contact surface rupturably fixed to one of the lid and the spout and a second contact surface fixed to the other one of the lid and the spout;

wherein the first contact surface is smaller than the second contact surface.

10. The lid-spout assembly according to claim 1, wherein a cross-section of the tamper evidence element has an oval or circular shape.

11. The lid-spout assembly according to claim 1, wherein the tamper-evidence element is rupturably fixed to the collar.

12. A package comprising a main body filled with a pourable product and at least one lid-spout assembly according to claim 1 and coupled to the main body.

13. The package according to claim 12, wherein the package is designed for the consumption on-the-go.

14. The package according to claim 12, wherein the main body is formed from a multilayer composite packaging material.

* * * * *